US012022858B2

(12) United States Patent
Liu et al.

(10) Patent No.: US 12,022,858 B2
(45) Date of Patent: Jul. 2, 2024

(54) HEAT-NOT-BURN CIGARETTE PRODUCT

(71) Applicant: CHINA TOBACCO GUANGDONG INDUSTRIAL CO., LTD., Guangdong (CN)

(72) Inventors: Yibo Liu, Guangdong (CN); Feng Li, Guangdong (CN); Jing Hu, Guangdong (CN); Ruifeng Zhao, Guangdong (CN); Zhijing Lu, Guangdong (CN); Yang Sun, Guangdong (CN); Xi Liu, Guangdong (CN); Huanwei Li, Guangdong (CN)

(73) Assignee: CHINA TOBACCO GUANGDONG INDUSTRIAL CO., LTD., Guangdong (CN)

( * ) Notice: Subject to any disclaimer, the term of this patent is extended or adjusted under 35 U.S.C. 154(b) by 800 days.

(21) Appl. No.: 17/259,555

(22) PCT Filed: Jul. 12, 2019

(86) PCT No.: PCT/CN2019/095698
§ 371 (c)(1),
(2) Date: Jan. 12, 2021

(87) PCT Pub. No.: WO2020/258385
PCT Pub. Date: Dec. 30, 2020

(65) Prior Publication Data

US 2021/0161200 A1 Jun. 3, 2021

(30) Foreign Application Priority Data

Jun. 27, 2019 (CN) ..... 201910568122.3

(51) Int. Cl.
*A24D 1/20* (2020.01)

(52) U.S. Cl.
CPC ..... *A24D 1/20* (2020.01)

(58) Field of Classification Search
None
See application file for complete search history.

(56) References Cited

U.S. PATENT DOCUMENTS

| | | | | |
|---|---|---|---|---|
| 10,076,137 | B2 * | 9/2018 | Krietzman | H05B 1/0244 |
| 2016/0331032 | A1 | 11/2016 | Malgat et al. | |

FOREIGN PATENT DOCUMENTS

| | | | |
|---|---|---|---|
| CN | 1633247 | A | 6/2005 |
| CN | 102946747 | A | 2/2013 |
| CN | 104135881 | A | 11/2014 |
| CN | 104754964 | A | 7/2015 |
| CN | 104770876 | | 7/2015 |
| CN | 104869855 | | 8/2015 |
| CN | 105072937 | | 11/2015 |
| CN | 105146734 | A | 12/2015 |
| CN | 108354236 | A | 8/2018 |
| CN | 109090699 | A | 12/2018 |
| CN | 109090705 | | 12/2018 |
| CN | 208192157 | U | 12/2018 |
| CN | 109259292 | A | 1/2019 |
| EP | 1489931 | A1 | 12/2004 |
| EP | 1265504 | B1 | 7/2009 |
| EP | 2800486 | A2 | 11/2014 |
| JP | 2003527127 | A | 9/2003 |
| JP | 2005517421 | A | 6/2005 |
| JP | 2016538850 | A | 12/2016 |
| KR | 20020080005 | A | 10/2002 |
| KR | 20040084899 | A | 10/2004 |
| KR | 20160096076 | A | 8/2016 |
| WO | 2008113335 | A2 | 9/2008 |
| WO | 2009092862 | A1 | 7/2009 |

OTHER PUBLICATIONS

"Flow Rate and Pressure Drop of Gas Through a Pipeline" , from https://planetcalc.com/8242/, retrieved Sep. 20, 2023.*
"Flow Calculation for Gases" from https://www.idealvalve.com/pdf/Flow-Calculation-for-Gases.pdf, retrieved Sep. 20, 2023.*
"International Search Report (Form PCT/ISA/210) "of PCT/CN2019/095698, mailed on Mar. 18, 2020, with English translation thereof, pp. 1-4.
"Written Opinion of the International Searching Authority (Form PCT/ISA/237)" of PCT/CN2019/095698, mailed on Mar. 18, 2020, pp. 1-3.

* cited by examiner

*Primary Examiner* — Ross N Gushi
(74) *Attorney, Agent, or Firm* — Samson G. Yu

(57) ABSTRACT

The invention provides a heat-not-burn cigarette product. The heat-not-burn cigarette product of the invention includes a cigarette product and a heater in matched use with the cigarette product. A sucking resistance when the cigarette product and the heater in matched use with the cigarette product are used together is $P_1$, and a sucking resistance of the cigarette product is $P_2$, wherein a ratio of $P_2/P_1$ is greater than or equal to 50%.

14 Claims, No Drawings

HEAT-NOT-BURN CIGARETTE PRODUCT

CROSS-REFERENCE TO RELATED APPLICATION

This application is a 371 of international application of PCT application serial no. PCT/CN2019/095698, filed on Jul. 12, 2019, which claims the priority benefit of China application no. 201910568122.3, filed on Jun. 27, 2019. The entirety of each of the above mentioned patent applications is hereby incorporated by reference herein and made a part of this specification.

BACKGROUND

Technical Field

The present invention relates to the technical field of aerosols, and more particularly, to a heat-not-burn cigarette product.

Description of Related Art

A heat-not-burn cigarette product usually includes a cigarette product and a heater in matched use with the cigarette product. The heater usually includes a power supply, a heating element, a cigarette product accommodating cavity, an opening, a control element and a shell accommodating the above parts. The cigarette product enters and exits the cigarette product accommodating cavity through the opening, and is in direct or indirect contact with the heating element. Heat is transferred to the cigarette product by the heating element to form an aerosol for a user.

During the whole forming process of the aerosol, the heating element heats to provide a temperature range required for operation and releases a volatile compound. There are many sucking resistances along the entire path for the aerosol to reach an oral cavity of the user. The total sucking resistances depend on the results of many changing factors including a specific property and a structure type of the cigarette product, a quantity of the cigarette products placed in the cavity, and an air channel design mode of the heater, or the like. In fact, the sucking resistance reflects smoothness of an airflow in the generating process of the aerosol, which is intuitive experience of a consumer during sucking, and is also an index that has a great influence on the sensory quality of sucking, smoke temperature and mouth contact temperature. Therefore, stability and size of the sucking resistance of the heat-not-burn cigarette product, and distribution of the sucking resistance of each part are all related to the overall sucking feeling, and directly affect recognition of the consumer on the product.

In the prior art, there are many disclosures on the reduction and adjustment of the sucking resistance, but most of the disclosures are aimed at the cigarette product, i.e., an aerosol forming matrix or the heating element alone, and there are few studies on influences of generation and relative distribution of a sucking resistance of a whole electric heating aerosol generating product on the total sucking experience. Only the adjustment of the sucking resistance of the cigarette product or only the adjustment of the sucking resistance on the heating element cannot ensure the influences of the total sucking resistance on the sucking sense in the final aerosol generating process, and improvement of a desired sensory effect is also unstable. CN109090705A in the prior art discloses a novel low-sucking-resistance groove filter stick. In this technical solution, the groove filter stick is wrapped by embossed groove paper outside a tow for cigarette subjected to opening and scotching and addition of additives, and then molded by filter stick molding paper and lap film, so that straight-through groove low-sucking-resistance filter sticks with various lengths and circumference specifications, pressure drop of 10 Pa/cm to 200 Pa/cm and bellows cooling effect can be prepared. This technical solution is also aimed at reducing the sucking resistance of the filter stick in the cigarette product.

Therefore, what is expected for the heat-not-burn cigarette product is the reasonable coordinated adjustment of the sucking resistances of each part of heat-not-burn cigarette and the total sucking resistance of the heat-not-burn cigarette product, so as to obtain a good sucking sense.

SUMMARY

A technical problem to be solved by the present invention is to overcome the defects and deficiencies of sucking resistance adjustment of the existing heat-not-burn cigarette product, and provide a heat-not-burn cigarette product which controls a total sucking resistance when a cigarette product and a heater in matched use with the cigarette product are used together, a sucking resistance of each part and a proportional relationship between the sucking resistance of each part and the total sucking resistance.

The above-mentioned objectives of the present invention are achieved by the following technical solutions.

A heat-not-burn cigarette product includes a cigarette product and a heater in matched use with the cigarette product, wherein a sucking resistance when the cigarette product and the heater in matched use with the cigarette product are used together is $P_1$, and a sucking resistance of the cigarette product is $P_2$, wherein a ratio of $P_2/P_1$ is greater than or equal to 50%.

A sucking resistance of a traditional cigarette may be used as a reference for designing a sucking resistance of a heat-not-burn tobacco product. It is easy to think of adjusting the sucking resistance of the latter to the same level as or slightly lower than that of the traditional cigarette. It is technically feasible to design the sucking resistance of the latter cigarette product and an air channel of a corresponding heater. However, the sucking resistance of the heat-not-burn cigarette product is different from that of a traditional burning tobacco product. With the consumption of the traditional cigarette and heat transfer, an internal structure of the disordered tobacco changes, and the sucking resistance changes greatly with sucking. The sucking resistance changes dynamically for consumption. A consumer may also decide a smoke amount and a smoke compensation rate according to a sucking manner thereof. More importantly, for the purpose of tar control, a sucking resistance of a mouth stick and a sucking resistance of the cigarette of the traditional cigarette are generally high, while a shape and the sucking resistance of the tobacco change relatively little before and after the traditional cigarette is used, and there is no purpose of reducing tar the heat-not-burn tobacco product is heated and baked instead of burned. In fact, compared with the traditional cigarette, tar of the heat-not-burn cigarette product is very low. Therefore, it is a top priority to choose a proper sucking resistance to satisfy the sucking experience.

Designing the sucking resistance of the heat-not-burn cigarette product to be at the same level as or slightly lower than that of the traditional cigarette will lead to unsmooth air intake of the heater in matched use with the former, or complicated cigarette structure, or too tight aerosol forming matrix, or the above problems exist at the same time, so as to cause great sucking resistance and insufficient smoke amount compensation. A remedial measure is to increase a temperature of a heating element, but it will also make it more difficult to cool the smoke, increase a heat protection difficulty of the heater, and increase heat risks. In addition, researches show that a proper physical state of the aerosol forming matrix is necessary for heat transfer and aerosol generation. Effects of the aerosol forming matrix in orderly axial arrangement and the aerosol forming matrix in disordered arrangement on the heat transfer and air flow path are different, and effects of inserting the heating element into the aerosol forming matrix on a physical form of the aerosol forming matrix cannot be ignored.

Therefore, for the heat-not-burn tobacco product, it is feasible to choose the sucking resistance different from that of the traditional cigarette to ensure the sucking experience. It is necessary to comprehensively consider cigarette structure design of the tobacco product, selection of a proper type and physical state of the aerosol forming matrix, the heating element of the heater in matched use, air channel design and a control program. Meanwhile, setting a proportion relationship between the sucking resistance of each part and the total sucking resistance will be beneficial to significantly improve a sensory quality.

It should be noted that the detection of the sucking resistance of each part of the present invention is that under a standard condition, when a stable airflow with a flow rate of 17.5 ml/s passes through a cigarette sample, a pressure difference at both ends of the sample represents the sucking resistance.

A specific method is as follows: (1) turning on a power supply on for preheating; (2) calibrating an instrument with high and low standard rods; (3) inserting an outlet end of the sample into a measuring head of the instrument by 9 mm and wrapping the sample in the measuring head tightly; and (4) reading and recording, and representing a result by Pa.

In addition, if the total sucking resistance when the cigarette product and the heater in matched use with the cigarette product are used together is to be tested, the cigarette should be inserted into a designated position of the heater in matched use for testing; if a tobacco section of the cigarette product is to be tested, the tobacco section should be carefully separated from a wrapping material to prevent the tobacco section from collapsing or deforming, and then the tobacco section is tested.

There are many factors that affect the sucking resistance. One is a structural size of each section, a density of an aerosol forming matrix section and a tobacco shape of the heat-not-burn tobacco product, and the wrapping material. The other is an air circuit design of the matched heater, which relates to heat and mass transfer and hydrodynamics, and affects the smoke amount and the smoke temperature of the heat-not-burn cigarette product, and even affects the temperature of the heater part and a temperature of a cigarette holder during sucking.

As an indivisible part of the heat-not-burn tobacco product, the heater affects the sucking experience together with the cigarette. The main affect is shown in the following three aspects.

For a sucking smoke temperature and a mouth contact temperature, there is no temperature problem in the traditional cigarette when being ignited for sucking, but the heat-not-burn cigarette product has a high requirement on temperature control. Limited by the structures of the heater and the cigarette, the temperature of the heat-not-burn cigarette product is higher in the first few gulps of sucking, and then the smoke temperature gradually decreases. If the smoke temperature is too high, it will bring burning sensation or injury to the consumer, which will not only affect the sucking sense, but also results in a safety problem, so the smoke temperature has to be taken seriously.

A smoke amount sucked represents an amount of substances sucked out, which, like the traditional cigarette, requires a certain amount of smoke. It is difficult to bring satisfaction to the consumer when the smoke amount is too small. If the smoke amount is too large, it means that the required temperature or energy will be high, or higher requirements are put forward for the aerosol forming matrix, which is unnecessary. Meanwhile, the smoke amount may be inconsistent with the traditional cigarette, and may be lower than that of the traditional cigarette, which is acceptable in some environments or to some consumers. Because the heat-not-burn is limited to the structure of the heater, a heat source and small mass of the aerosol forming matrix, there will be a phenomenon that the smoke amount is large in an early stage of sucking and gradually decreases with the consumption of substances in a later stage, and there will also be a phenomenon that the smoke amount is small in first few stages, large in a middle stage of sucking and small in the later stage (similar to parabola). Therefore, it is necessary to maintain stability of gulp by gulp sucking in the heat-not-burn tobacco product, or keep stability of the smoke amount within a preset number of sucking gulps, which requires the cooperation of the heating element, the temperature control procedure, the air channel design and the heat-not-burn cigarette design.

Strength is a core of affecting the sucking satisfaction, which is the same as the traditional cigarette. Choosing a proper strength is conducive to enhancing the consumption experience.

Preheating time determines waiting time for the consumer to suck, which does not exist in the traditional cigarette. For the heat-not-burn cigarette product, proper preheating time can not only ensure that the aerosol forming matrix section can be fully baked to ensure the smoke amount sucked and improve the satisfaction, but also play a good role in controlling the temperature. However, when the preheating time is too long, not only more energy is consumed, but also the waiting time is increased. The preheating time depends on the heating element, the control method, the structure of the cigarette product and the shape of the aerosol forming matrix.

Sucking resistance represents the resistance of sucking, indicates smoothness of the air channel of the cigarette product and the heater in matched use with the cigarette product. In the traditional cigarette, the sucking resistance is a physical index that has a great influence on the sensory quality and a tar content of the cigarette. In general, when the sucking resistance increases, the smoke tends to be bland, and when the sucking resistance is too large, it will lead to difficulty in sucking. For the heat-not-burn tobacco product, the sucking resistance not only affects the smoke amount, but also has a certain relationship with the smoke temperature including the temperature of the heater. Choosing a proper sucking resistance is very important for the consumption experience.

The heater of the present invention may be an electric heater containing a battery or an electric heater without a battery. The electric heater may be a heating device using a peripheral heating manner or a central heating manner, or any other heating device which can heat the aerosol forming matrix including tobacco substances to a temperature range required for forming the aerosol.

The heater of the present invention may also be an electric heater using other heating manners such as infrared heating.

More preferably, a ratio of $P_2/P_1$ is 50% to 85%. For example, the ratio of $P_2/P_1$ may be 50%, the ratio of $P_2/P_1$ may be 80%, or the ratio of $P_2/P_1$ may be 85%.

Preferably, the cigarette product section includes an aerosol forming matrix section, a smoke gathering section and a mouth contact section, the smoke gathering section is located between the aerosol forming matrix section and the mouth contact section, and a sucking resistance of the aerosol forming matrix section is $P_{21}$, wherein a ratio of $P_{21}/P_2$ is 50% to 90%.

It should be noted here that the aerosol forming matrix section of the present invention may be self-prepared in any form of heat-not-burn tobacco products containing tobacco raw materials.

The function of the aerosol forming matrix section is to generate an aerosol when heated, and all or part of constituents thereof are tobacco or treated tobacco constituents. The tobacco constituents include but are not limited to one of a flue-cured tobacco, a mixed tobacco, a sun-cured tobacco, a reconstituted tobacco and an expanded tobacco, and any combination thereof. The tobacco shape is not limit to one of strips, cut tobaccos, sheets, particles and powders, and any combination thereof. The aerosol forming matrix section may be a disordered structure composed of one or more tobacco constituents mentioned above, and may also be an ordered structure or a homogeneous structure composed of one or more tobacco constituents mentioned above. Moreover, the aerosol forming matrix section may further include a certain amount of constituents capable of fogging by heating, such as propylene glycol and glycerol, or material constituents containing a fogging constituent, and further include other components or constituents, so as to achieve the effects of enhancing fragrance, adjusting style, and masking or inhibiting release of a certain constituent.

A weight or density of the substances contained in the aerosol forming matrix section needs to be in a proper range, which not only meets the smoke amount, adjusts and controls the sucking resistance, but also ensures the rapid and effective transfer of heat. If the weight or density is too small, the manufacturing is difficult, and the smoke amount is insufficient. If the weight or density is too large, unsmooth airflow and large sucking resistance are caused.

The smoke gathering section of the present invention is made of materials with a certain pore or through hole structure, and has the main functions that: firstly, the aerosol generated by the aerosol forming matrix containing the tobacco substances is cached in the smoke gathering section so as to reduce the sucking resistance during sucking and provide the aerosol to the consumer in time; secondly, the smoke gathering section realizes efficient heat exchange through physical space or special structures and materials, so as to achieve the effect of cooling the smoke; and another possible function of the smoke gathering section is to use structural materials with a certain strength to play a supporting role, so as to prevent the cigarette structure from deforming in manufacturing, transportation or use processes.

The smoke gathering section may be a single material or a plurality of materials, or a composite material, may be an inorganic non-metallic material, a polymer material, a metallic material and combinations thereof, may be a material with high thermal conductivity, and may also be a phase-change material, may be a single structure, or a plurality of structures arranged axially according to certain rules, and meanwhile, the related aerosols may be treated with certain constituents, moisture retention, fragrance enhancement and fragrance adjustment according to the actual requirements. The mouth contact section of the present invention is a joint end of the aerosol and an oral cavity of a user, and the aerosol is sucked into the oral cavity of the user through the mouth contact section after subjecting all levels of processing for the cigarette product.

Preferably, the ratio of $P_{21}/P_2$ is 50% to 85%.

More preferably, the ratio of $P_2/P_1$ is 50%, and the ratio of $P_{21}/P_2$ is 66% to 75%.

Preferably, the sucking resistance $P_1$ when the cigarette product and the heater in matched use with the cigarette product are used together is 200 Pa to 700 Pa. For example, the sucking resistance may be 200 Pa, 600 Pa or 700 Pa.

Preferably, the sucking resistance $P_2$ of the cigarette product section is 150 Pa to 500 Pa. Preferably, the sucking resistance $P_{21}$ of the aerosol forming matrix section is 100 Pa to 400 Pa.

In order to achieve the control of the sucking resistance of each section of the heat-not-burn cigarette product mentioned above and the distribution control of the total sucking resistance, preferably, a porosity factor of the smoke gathering section is greater than or equal to 60%.

Preferably, the smoke gathering section includes a plurality of parts or structures which are sequentially arranged along an axial direction, or a structure which changes along the axial direction, and the porosity factor of the smoke gathering section of at least one part or one structure on a path through which the aerosol passes is greater than or equal to 60%.

Compared with the prior art, the present disclosure has the beneficial effects as follows.

(1) The present invention provides the heat-not-burn cigarette product. By controlling the sucking resistance of the heater in matched use with the heat-not-burn cigarette product and the cigarette product and the proportional relationship between the sucking resistance and the total sucking resistance, the sucking sense of the heat-not-burn cigarette product is greatly improved, the smoke amount and the smoke temperature can reach a score of about 8, a score of the overall sucking sense score is also about 8, the smoke amount is more abundant, and the smoke temperature and the cigarette holder temperature are both reduced to a certain extent, which better matches the needs of the user.

(2) The sucking resistance of the cigarette product section in the heat-not-burn cigarette product of the present invention accounts for more than 50% of the total sucking resistance of the heat-not-burn cigarette product, thus realizing optimized design of the air channel and proper supply of air, realizing balance between the sucking resistance and the smoke amount, and improving the sucking feeling.

(3) The sucking resistance of the aerosol forming matrix section in the heat-not-burn cigarette product of the present invention accounts for 50% to 90% of the sucking resistance of the cigarette product section, thus achieving effects of sufficient smoke amount and low interception.

DESCRIPTION OF THE EMBODIMENTS

The present invention will be further described below with reference to the specific implementation manners, but the embodiments are not intended to limit the present invention in any form. Unless defined otherwise, the raw material reagents used in the embodiments of the invention are conventionally purchased raw material reagents.

Embodiment 1

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, and a sucking resistance of the cigarette product was $P_2$, wherein a ratio of $P_2/P_1$ was greater than or equal to 50%.

Embodiment 2

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, and a sucking resistance of the cigarette product was $P_2$, wherein a ratio of $P_2/P_1$ was greater than or equal to 80%.

Embodiment 3

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, and a sucking resistance of the aerosol forming matrix section was $P_{21}$, wherein a ratio of $P_{21}/P_2$ was 50%.

Embodiment 4

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, and a sucking resistance of the aerosol forming matrix section was $P_{21}$, wherein a ratio of $P_{21}/P_2$ was 80%.

Embodiment 5

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, and a sucking resistance of the aerosol forming matrix section was $P_{21}$, wherein a ratio of $P_{21}/P_2$ was 66%.

Embodiment 6

A heat-not-burn cigarette product included a cigarette product and a heater in matched use with the cigarette product, wherein the cigarette product included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, and a sucking resistance of the aerosol forming matrix section was $P_{21}$, wherein a ratio of $P_{21}/P_2$ was 75%.

Embodiment 7

A heat-not-burn cigarette product included a cigarette product and a heater in matched use with the cigarette product, wherein the cigarette product section included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, a value of $P_1$ was 200 Pa, the sucking resistance $P_2$ of the cigarette product was 150 Pa, and a sucking resistance $P_{21}$ of the aerosol forming matrix section was 100 Pa.

Embodiment 8

A heat-not-burn cigarette product included a cigarette product and a heater in matched use with the cigarette product, wherein the cigarette product section included an aerosol forming matrix section, a smoke gathering section and a mouth contact section, a sucking resistance when the cigarette product and the heater in matched use with the cigarette product were used together was $P_1$, a sucking resistance of the cigarette product was $P_2$, a ratio of $P_2/P_1$ was 50%, a value of $P_1$ was 600 Pa, the sucking resistance $P_2$ of the cigarette product was 500 Pa, and a sucking resistance $P_{21}$ of the aerosol forming matrix section was 400 Pa.

Comparative Example 1

An aerosol generating product included a cigarette product and a heater in matched use with the cigarette product, wherein a sucking resistance when the cigarette product and the heater in matched use with the cigarette product were used together was $P_1$, and a sucking resistance of the cigarette product was $P_2$, wherein a ratio of $P_2/P_1$ was 40%.

Result Detection

The sucking resistance adjustment of the present invention had the main beneficial effects of improving an air intake effect, being beneficial to aerosol generation, reducing aerosol interception, being beneficial to reducing the smoke temperature and improving the sucking sense experience including the smoke amount and the smoke temperature. A ten-score system was employed. For the smoke amount, 1 to 3 scores indicated small smoke amount, 4 to 6 scores indicated moderate smoke amount, 7 to 8 scores indicated relatively sufficient smoke amount, and 9 to 10 scores indicated sufficient smoke amount. For the smoke temperature, 1 to 3 scores indicated that the smoke temperature was hot, 4 to 6 scores indicated that the smoke temperature was relatively hot, 7 to 8 scores indicated that the smoke temperature is relatively comfortable, and 9 to 10 scores indicated that the smoke temperature was comfortable. The comprehensive evaluation referred to the overall evaluation on the smoke amount, the smoke temperature, and the smoke release consistency, wherein 1 to 3 scores indicated poor comprehensive performances, 4 to 6 scores indicated general comprehensive performances, 7 to 8 scores indicated relatively good comprehensive performances, and 9 to 10 scores indicated good comprehensive performances.

(1) Overall Sensory Evaluation of Sucking

TABLE 1

Scoring Table of Sensory Evaluation of Each Embodiment and Comparative Example

| Serial number | Smoke amount | Smoke temperature | Overall score |
|---|---|---|---|
| Embodiment 1 | 8 | 8 | 8 |
| Embodiment 2 | 8 | 8 | 7 |
| Embodiment 3 | 8 | 8 | 8 |
| Embodiment 4 | 9 | 8 | 8 |
| Embodiment 5 | 9 | 8 | 9 |
| Embodiment 6 | 9 | 9 | 9 |
| Embodiment 7 | 8 | 8 | 8 |
| Embodiment 8 | 8 | 8 | 8 |
| Comparative Example 1 | 6 | 6 | 6 |

It should be noted that: for the above tests, heaters of the same type were employed, and structure, heating elements, temperature control programs and overall structure are all the same. The difference lies in the difference of air intake channels and manners, which is only manifested in the difference of the sucking resistance values.

(2) Related Index Detection a. The smoke amount was tested by a weight reduction method and carried out by using an ISO standard smoking method, i.e., 35 ml/2 s/30 s. After seven gulps, a mass difference before and after sucking was calculated, and the test results of each embodiment were divided by the results of Comparative Example 1 to obtain a relative value of the smoke amount.

b. A temperature on the surface of the cigarette 5 mm away from a cigarette holder end and the smoke temperature in the center position were tested by a thermocouple. The maximum temperature value of the tested smoke of seven gulps and the maximum temperature on the surface of the cigarette were taken.

TABLE 2

List of Sensory Related Test Data

| Serial number | Smoke amount | Maximum temperature of smoke/° C. | Maximum temperature of cigarette holder/° C. |
|---|---|---|---|
| Embodiment 1 | 1.12 | 50 | 41 |
| Embodiment 2 | 1.23 | 49 | 40 |
| Embodiment 3 | 1.15 | 51 | 41 |
| Embodiment 4 | 1.27 | 46 | 37 |
| Embodiment 5 | 1.31 | 49 | 39 |
| Embodiment 6 | 1.35 | 50 | 41 |
| Embodiment 7 | 1.18 | 53 | 42 |
| Embodiment 8 | 1.29 | 55 | 45 |
| Comparative Example 1 | 1.00 | 60 | 50 |

It can be seen from the data of the above-mentioned embodiments and Comparative Example 1 that the sucking resistance of the cigarette product is controlled by the present invention to account for more than 50% of the sucking resistance when the cigarette product and the heater in matched use with the cigarette product are used together. Compared with that of Comparative Example 1, the sucking resistance of the cigarette product accounting for the sucking resistance when the cigarette product and the heater in matched use with the cigarette product are used together is improved both in the smoke amount sucked and the maximum temperatures of the smoke and the cigarette holder. Compared with Comparative Example 1, the smoke amount sucked is more abundant, the maximum temperatures of the smoke and the cigarette holder are both reduced to a certain extent, and the overall sucking sense is greatly improved, which is consistent with the results of the above-mentioned sensory sucking scores.

Obviously, the above-mentioned embodiments of the present invention are merely examples for clearly illustrating the present invention, but are not intended to limit the implementations of the present invention. For those of ordinary skills in the art, other different forms of changes or variations can be made on the basis of the above description. It is not necessary or possible to exhaust all the implementations here. Any modifications, equivalent substitutions, and improvements made within the spirit and principle of the present invention shall all fall within the scope of protection claimed by the present invention.

What is claimed is:

1. A heat-not-burn cigarette product comprising a cigarette product and a heater in matched use with the cigarette product, wherein a sucking resistance when the cigarette product and the heater in matched use with the cigarette product are used together is $P_1$, and a sucking resistance of the cigarette product is $P_2$, wherein a ratio of $P_2/P_1$ is 50% to 85%;

wherein a sucking resistance represents a resistance of sucking; the cigarette product comprises an aerosol forming matrix section, a smoke gathering section and a mouth contact section, the smoke gathering section is located between the aerosol forming matrix section and the mouth contact section, and all or part of constituents of the aerosol forming matrix section are tobacco or treated tobacco constituents, and the tobacco comprises one of a flue-cured tobacco, a mixed tobacco, a sun-cured tobacco, a reconstituted tobacco and an expanded tobacco, and any combination thereof.

2. The heat-not-burn cigarette product according to claim 1, wherein the sucking resistance $P_1$ when the cigarette product and the heater in matched use with the cigarette product are used together is 200 Pa to 700 Pa.

3. The heat-not-burn cigarette product according to claim 1, wherein the sucking resistance $P_1$ when the cigarette product and the heater in matched use with the cigarette product are used together is 200 Pa to 700 Pa.

4. The heat-not-burn cigarette product according to claim 3, wherein the sucking resistance $P_2$ of the cigarette product is 150 Pa to 500 Pa.

5. The heat-not-burn cigarette product according to claim 4, wherein the sucking resistance $P_{21}$ of the aerosol forming matrix section is 100 Pa to 400 Pa.

6. The heat-not-burn cigarette product according to claim 5, wherein a porosity factor of the smoke gathering section is greater than or equal to 60%.

7. The heat-not-burn cigarette product according to claim 1, a sucking resistance of the aerosol forming matrix section is $P_{21}$, wherein a ratio of $P_{21}/P_2$ is 50% to 90%.

8. The heat-not-burn cigarette product according to claim 7, wherein the sucking resistance $P_1$ when the cigarette product and the heater in matched use with the cigarette product are used together is 200 Pa to 700 Pa.

9. The heat-not-burn cigarette product according to claim 7, wherein the ratio of $P_{21}/P_2$ is 50% to 80%.

10. The heat-not-burn cigarette product according to claim 9, wherein the sucking resistance $P_1$, when the cigarette product and the heater in matched use with the cigarette product are used together is 200 Pa to 700 Pa.

11. The heat-not-burn cigarette product according to claim 9, wherein the ratio of $P_{21}/P_2$ is 66% to 75%.

12. The heat-not-burn cigarette product according to claim 11, wherein the sucking resistance $P_1$ when the cigarette product and the heater in matched use with the cigarette product are used together is 200 Pa to 700 Pa.

13. The heat-not-burn cigarette product according to claim 11, wherein the ratio of $P_2/P_1$ is 50%, and the ratio of $P_1/P_2$ is 66% to 75%.

14. The heat-not-burn cigarette product according to claim 13, wherein the sucking resistance $P_1$ when the cigarette product and the heater in matched use with the cigarette product are used together is 200 Pa to 700 Pa.

* * * * *